US006605206B1

(12) United States Patent
Johnson et al.

(10) Patent No.: US 6,605,206 B1
(45) Date of Patent: Aug. 12, 2003

(54) PROCESS FOR INCREASING THE YIELD OF LUBRICATING BASE OIL FROM A FISCHER-TROPSCH PLANT

(75) Inventors: David R. Johnson, Petaluma, CA (US); Christopher A. Simmons, El Cerrito, CA (US); Donald H. Mohr, Orinda, CA (US); Stephen J. Miller, San Francisco, CA (US); Stephen K. Lee, Oakland, CA (US); William L. Schinski, San Rafael, CA (US); Michael S. Driver, San Francisco, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 10/071,281

(22) Filed: Feb. 8, 2002

(51) Int. Cl.[7] ..... C10G 67/17; C10G 73/44; C07C 1/04; C07C 1/24

(52) U.S. Cl. ..... 208/80; 208/78; 208/950; 585/304; 585/327

(58) Field of Search ..... 208/78, 80, 950; 585/304, 327

(56) References Cited

U.S. PATENT DOCUMENTS

| | | | | |
|---|---|---|---|---|
| 3,852,207 A | | 12/1974 | Stangeland et al. | |
| 4,125,566 A | * | 11/1978 | Trin Dinh et al. | 208/65 |
| 4,133,841 A | * | 1/1979 | Cosyns et al. | 208/64 |
| 4,176,050 A | | 11/1979 | Chen et al. | |
| 4,181,598 A | | 1/1980 | Gillespie et al. | |
| 4,211,635 A | | 7/1980 | Chen | |
| 4,222,855 A | | 9/1980 | Pelrine et al. | |
| 4,229,282 A | | 10/1980 | Peters et al. | |
| 4,417,088 A | | 11/1983 | Miller | |
| 4,544,792 A | * | 10/1985 | Smith et al. | 585/533 |
| 4,547,601 A | * | 10/1985 | Holland et al. | 585/310 |
| 4,673,487 A | | 6/1987 | Miller | |
| 4,827,064 A | | 5/1989 | Wu | |
| 4,827,073 A | | 5/1989 | Wu | |
| 4,859,311 A | | 8/1989 | Miller | |
| 4,990,709 A | | 2/1991 | Wu | |
| 5,082,986 A | | 1/1992 | Miller | |
| 5,135,638 A | | 8/1992 | Miller | |
| 5,246,566 A | | 9/1993 | Miller | |
| 5,282,958 A | | 2/1994 | Santilli et al. | |
| 5,453,556 A | * | 9/1995 | Chang et al. | 585/524 |
| 5,723,716 A | | 3/1998 | Brandes et al. | |
| 5,939,349 A | | 8/1999 | Kibby et al. | |
| 6,080,301 A | | 6/2000 | Berlowitz et al. | |

FOREIGN PATENT DOCUMENTS

EP 0609 079 B1 7/1998

* cited by examiner

*Primary Examiner*—Walter D. Griffin
(74) *Attorney, Agent, or Firm*—James W. Ambrosius

(57) ABSTRACT

A process for increasing the yield of $C_{10}$ plus hydrocarbon products from a Fischer-Tropsch plant which comprises the steps of (a) separating a Fischer-Tropsch product into a wax fraction and a condensate fraction; (b) dewaxing the wax fraction to produce a high boiling intermediate; (c) hydrofinishing the high boiling intermediate; (d) dehydrating the alcohols in the condensate fraction to convert them into olefins; (e) oligomerizing the olefins to form higher molecular weight hydrocarbons; (f) hydrofinishing the oligomerization mixture; and (g) and recovering a $C_{10}$ plus hydrocarbon product from the hydrofinishing zone.

35 Claims, 2 Drawing Sheets

PROCESS FOR INCREASING THE YIELD OF LUBRICATING BASE OIL FROM A FISCHER-TROPSCH PLANT

FIELD OF THE INVENTION

The invention relates to a process for upgrading Fischer-Tropsch products by increasing the yield of diesel and lubricating base oil produced from a Fischer-Tropsch plant.

BACKGROUND OF THE INVENTION

The market for lubricating base oils of high paraffinicity is continuing to grow due to the high viscosity index, oxidation stability, and low volatility relative to viscosity of these molecules. The products produced from the Fische-Tropsch process contain a high proportion of wax which make them ideal candidates for processing into lubricating base oil stocks. Accordingly, the hydrocarbon products recovered from the Fischer-Tropsch process have been proposed as feedstocks for preparing high quality lubricating base oils. See, for example, U.S. Pat. No. 6,080,301 which describes a premium lubricating base oil having a high non-cyclic isoparaffin content prepared from Fischer-Tropsch waxes by hydroisomerization dewaxing and solvent dewaxing. Lubricating base oils typically will have an initial boiling point above about 315 degrees C. (600 degrees F.). High quality diesel products also may be prepared from the syncrude recovered from the Fischer-Tropsch process. Fischer-Tropsch derived diesel typically has a very low sulfur and aromatics content and an excellent cetane number. These qualities make Fischer-Tropsch derived diesel an excellent blending stock for upgrading lower quality petroleum-derived diesel. Accordingly, it is desirable to be able to maximize the yields of such higher value hydrocarbon products which boil within the range of lubricating base oils and diesel. At the same time, it is desirable to minimize the yields of lower value products such as naphtha and $C_4$ minus products.

All syncrude Fischer-Tropsch products as they are initially recovered from the Fischer-Tropsch reactor contain varying amounts of olefins depending upon the type of Fischer-Tropsch operation employed. In addition, the crude Fischer-Tropsch product also contains a certain amount of oxygenated hydrocarbons, especially alcohols, which may be readily converted to olefins by a dehydration step. These olefins may be oligomerized to yield hydrocarbons having a higher molecular weight than the original feed. Oligomerization also introduces desirable branching into the hydrocarbon molecule which lowers the pour point of the diesel and lubricating base oil products, thereby improving the cold flow properties of the product. See for example U.S. Pat. No. 4,417,088.

Fischer-Tropsch wax refers to a high boiling fraction from the Fischer-Tropsch derived syncrude and is most often a solid at room temperature. For the purpose of this disclosure "Fischer-Tropsch wax" will be contained in the higher boiling portion of the Fischer-Tropsch syncrude. Fischer-Tropsch wax contains at least 10% by weight of $C_{20}$ and higher hydrocarbonaceous compounds, preferably at least 40% by weight of $C_{20}$ and higher hydrocarbonaceous compounds, and most preferably at least 70% by weight of $C_{20}$ and higher hydrocarbonaceous compounds. Fischer-Tropsch wax is important for the present invention because this fraction will contain the heavier hydrocarbons which will be sent to the catalytic dewaxing operation. Depending on how the operation is run, the majority of the Fischer-Tropsch wax may be converted to high quality lubricating base oil and diesel.

As used in this disclosure, the term "$C_{19}$ minus Fischer-Tropsch product" refers to a product recovered from a Fischer-Tropsch reaction zone which is predominantly comprised of hydrocarbons having 19 carbon atoms or less in the molecular backbone. One skilled in the art will recognize that such products may actually contain a significant amount of hydrocarbons containing greater than 19 carbon atoms. In general, what is referred to are those hydrocarbons having a boiling range of diesel and below. In general, for the purposes of this disclosure, diesel is considered as having a upper boiling point of about 700 degrees F. (370 degrees C.) and an initial boiling point of about 300 degrees F. (about 150 degrees C.). Diesel may also be referred to as $C_{10}$ to $C_{19}$ hydrocarbons. Likewise, Fischer-Tropsch wax preferably is comprised predominantly of "$C_{20}$ plus product" which refers to a product comprising primarily hydrocarbons having 20 or more carbon atoms in the backbone of the molecule and having an initial boiling point at the upper end of the boiling range for diesel, i.e., above about 600 degrees F. (315 degrees C.). It should be noted that the upper end of the boiling range for diesel and the lower end of the boiling range for Fischer-Tropsch wax have considerable overlap. The term "naphtha" when used in this disclosure refers to a liquid product having between about $C_5$ to about $C_9$ carbon atoms in the backbone and will have a boiling range generally below that of diesel but wherein the upper end of the boiling range will overlap that of the initial boiling point of diesel. The term $C_{10}$ plus hydrocarbons refers to those hydrocarbons generally boiling above the range of naphtha, i.e., the fractions boiling within the range of diesel and lubricating base oils or above about 150 degrees C. Products recovered from the Fischer-Tropsch synthesis which are normally in the gaseous phase at ambient temperature are referred to as $C_4$ minus product in this disclosure. LPG which is primarily a mixture of propane and butane is an example of a $C_4$ minus product. The precise cut-point selected for each of the products in carrying out the distillation operation will be determined by the product specifications and yields desired.

As used in this disclosure the words "comprises" or "comprising" is intended as an open-ended transition meaning the inclusion of the named elements, but not necessarily excluding other unnamed elements. The phrase "consists essentially of" or "consisting essentially of" is intended to mean the exclusion of other elements of any essential significance to the composition. The phrases "consisting of" or "consists of" are intended as a transition meaning the exclusion of all but the recited elements with the exception of only minor traces of impurities.

SUMMARY OF THE INVENTION

The present invention is directed to a process for increasing the yield of $C_{10}$ plus hydrocarbon products from a Fischer-Tropsch plant which comprises (a) recovering separately from a Fischer-Tropsch reactor a Fischer-Tropsch wax fraction and a Fischer-Tropsch condensate fraction, wherein the Fischer-Tropsch condensate fraction contains alcohols boiling below about 370 degrees C.; (b) dewaxing the Fischer-Tropsch wax fraction in a catalytic dewaxing zone to produce a high boiling intermediate having a lower pour point as compared to the Fischer-Tropsch wax fraction; (c) hydrofinishing the high boiling intermediate in a hydrofinishing zone; (d) contacting the Fischer-Tropsch condensate fraction separated in step (a) with a dehydration catalyst in a dehydration zone, whereby at least some of the alcohols present in the fraction are converted to olefins; (e) oligomerizing the olefins in the Fischer-Tropsch condensate fraction to form a intermediate oligomerization mixture having a higher average molecular weight than the Fischer-Tropsch condensate fraction; (f) hydrofinishing the intermediate oligomerization mixture in the hydrofinishing zone; and (g) and recovering from the hydrofinishing zone a $C_{10}$ plus hydrocarbon product. The term Fischer-Tropsch condensate fraction refers generally to that $C_5$ plus fraction which has a lower boiling range than the Fischer-Tropsch wax fraction. That is to say, that fraction which is normally liquid at ambient temperature.

In the prior embodiment the alcohols in the Fischer-Tropsch condensate undergo a dehydration step to convert them into olefins. In an alternative embodiment, the entire Fischer-Tropsch syncrude is sent to a pre-treatment operation which includes the dehydration step prior to separation of the syncrude into the Fischer-Tropsch wax fraction and the Fischer-Tropsch condensate fraction. Accordingly, the process may also be described as a process for increasing the yield of $C_{10}$ plus hydrocarbon products from a Fischer-Tropsch plant which comprises: (a) contacting a feedstock comprising $C_5$ plus products and alcohols recovered from the Fischer-Tropsch plant with a dehydration catalyst under dehydration conditions to convert at least some of the alcohols present into olefins; (b) separately recovering from the dehydrated feedstock a Fischer-Tropsch wax fraction and a Fischer-Tropsch condensate fraction comprising both saturated hydrocarbons and olefins having an upper boiling point below about 370 degrees C.; (c) dewaxing the Fischer-Tropsch wax fraction in a catalytic dewaxing zone to produce a high boiling intermediate having a lower pour point as compared to the Fischer-Tropsch wax fraction; (d) hydrofinishing the high boiling intermediate in a hydrofinishing zone; (e) oligomerizing the olefins in the Fischer-Tropsch condensate fraction recovered in step (b) to form a intermediate oligomerization mixture having a higher average molecular weight than the Fischer-Tropsch condensate fraction; (f) hydrofinishing the intermediate oligomerization mixture in the hydrofinishing zone; and (g) and recovering from the hydrofinishing zone a $C_{10}$ plus hydrocarbon product. In this embodiment, it may be desirable to also include the removal of various catalyst poisons during the pretreatment of the feedstock. In this embodiment, some normally gaseous olefins, such as ethylene, propene, and butene, also may be present and will undergo oligomerization to yield higher molecular weight products.

The present invention is particularly advantageous for producing high quality lubricating base oils. A special benefit of the presentprocess is that it may be used to produce bright stock which is a high viscosity, highly refined, and dewaxed premium product. In conventional petroleum operations bright stock is produced from residual stocks or bottoms and has a high commercial value. Bright stock is named for the SUS viscosity at 210 degrees F., having viscosities above 180 cSt at 40 degrees C., more preferably above 250 cSt at 40 degrees C., and still more preferably ranging from about 500 to 1100 cSt at 40 degrees C.

The dewaxing of the Fischer-Tropsch wax is preferably carried out as a catalytic hydroisomerization step in order to minimize the wax cracking which reduces the yield of the higher molecular weight products. Accordingly, the use of hydroisomerization catalysts, such as SAPO-11, in combination with a noble metal, such as platinum or palladium, are particularly preferred for use in the dewaxing operation.

DETAILED DESCRIPTION OF THE INVENTION

Figure 1:
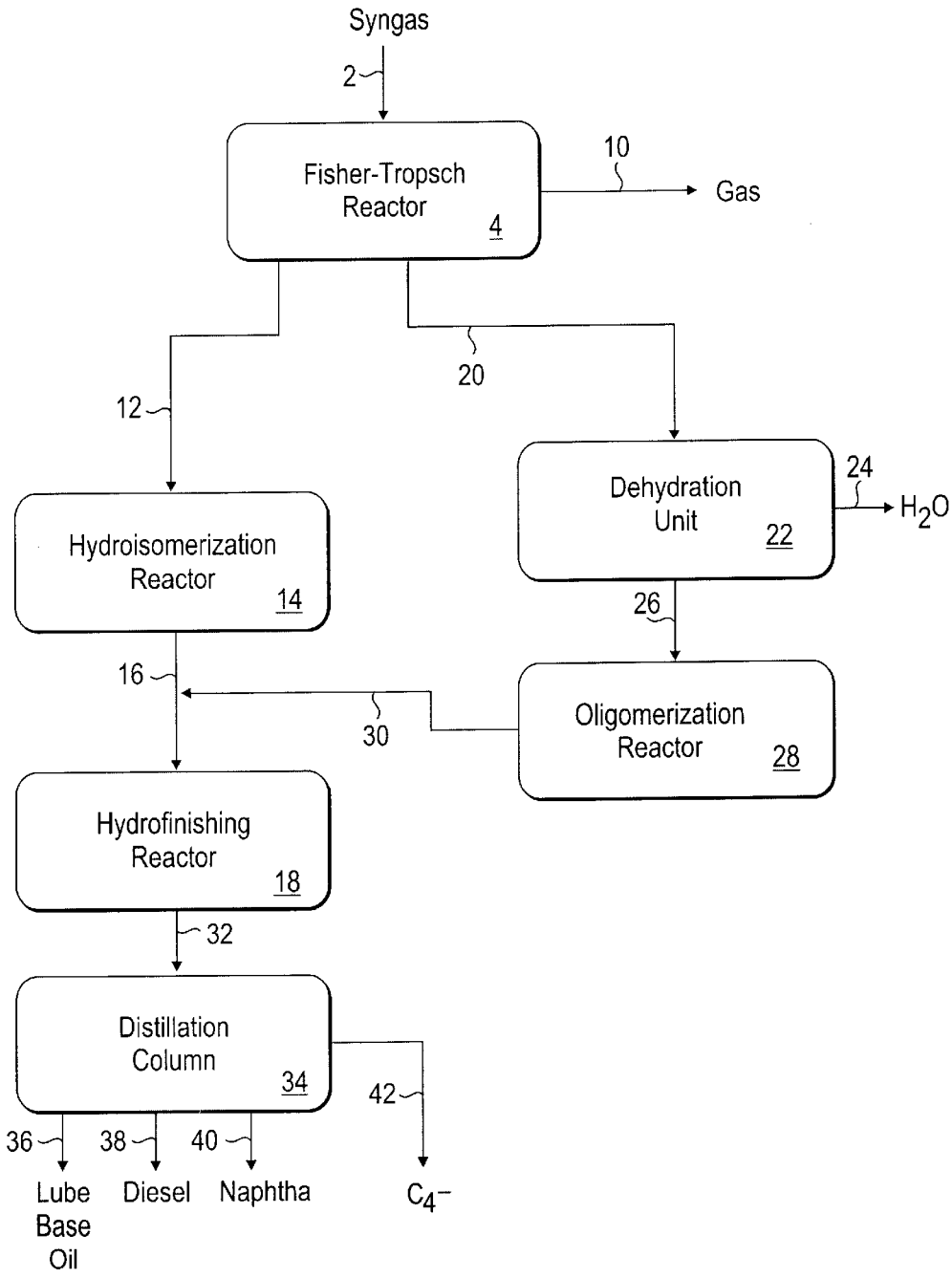
FIG. 1 is a schematic diagram of one embodiment of the present invention in which the Fischer-Tropsch condensate is sent to the dehydration unit after being recovered from the Fischer-Tropsch reactor.

The process of the present invention will be more fully understood by reference to the drawings. FIG. 1 is a schematic representation of one embodiment of the invention. In this embodiment, the synthesis gas or syngas comprised primarily of carbon monoxide and hydrogen is sent to the Fischer-Tropsch reactor 4 via feed inlet 2. In this embodiment the Fischer-Tropsch reactor uses a slurry bed to carry out the Fischer-Tropsch synthesis. Three different phases are shown as separately leaving the slurry-bed reactor. A mixture of overhead gases consisting of unreacted carbon monoxide and hydrogen along with light $C_4$ minus hydrocarbons are collected by outlet 10. The normally liquid Fischer-Tropsch condensate fraction is collected separately by outlet 20 from the normally solid Fischer-Tropsch wax fraction collected by outlet 12.

The Fischer-Tropsch liquid fraction, called condensate, consists primarily of $C_5$ plus molecules, but may also contain substantial amounts of $C_2$–$C_4$ light ends. The condensate contains paraffins, olefins, oxygen compounds (primarily alcohols and usually lesser amounts of oxygenated hydrocarbons, such as aldehydes, acids, ketones, peroxides, ethers, and esters) and trace amounts of nitrogen compounds. The Fischer-Tropsch wax fraction contains paraffins and olefins plus oxygen and nitrogen compounds.

The Fischer-Tropsch wax fraction is passed to the hydroisomerization reactor 14 where the wax is isomerized to lower its pour point. The isomerized wax referred to in this disclosure as a high boiling intermediate is collected by outlet 16 and carried to the hydrofinishing reactor 18. Returning to the Fischer-Tropsch reactor 4, the Fischer-Tropsch condensate collected by outlet 20 is carried to the dehydration unit 22 where at least some, and preferably all, of the alcohols are converted to olefins. The water from the dehydration reaction and any free water remaining from the Fischer-Tropsch reaction are collected by the overhead outlet 24. An optional pretreatment step not shown in the figure may be included to remove contaminates which may deactivate the oligomerization catalyst in the following step. The contaminants include water, residual oxygen compounds, and nitrogen compounds. The dehydrated condensate is carried by conduit 26 to the oligomerization reactor 28 where the olefins in the condensate fraction are oligomerized over an oligomerization catalyst to produce an intermediate oligomerization mixture having a higher average molecular weight than the dehydrated Fischer-Tropsch condensate. Fully saturated hydrocarbons originally in the Fischer-Tropsch condensate will pass through the oligomerization reactor unchanged. The intermediate oligomerization mixture is collected by conduit 30 and mixed with the high boiling intermediate collected in outlet 16 from the hydroisomerization reactor 14. The intermediate oligomerization mixture and the high boiling intermediate are introduced together into the hydrofinishing reactor 18 where any aromatics and residual olefins are saturated to improve the oxidation stability and the color of the final products. The hydrofinished products from the hydrofinishing reactor are carried by conduit 32 to a distillation column 34 where the various products are separately collected. In the figure, the primary products are shown as lubricating base oil 36 and diesel 38. Naphtha 40 is also produced in the process as well as some $C_4$ minus product 42 mostly comprising liquefied petroleum gas or LPG.

Figure 2:
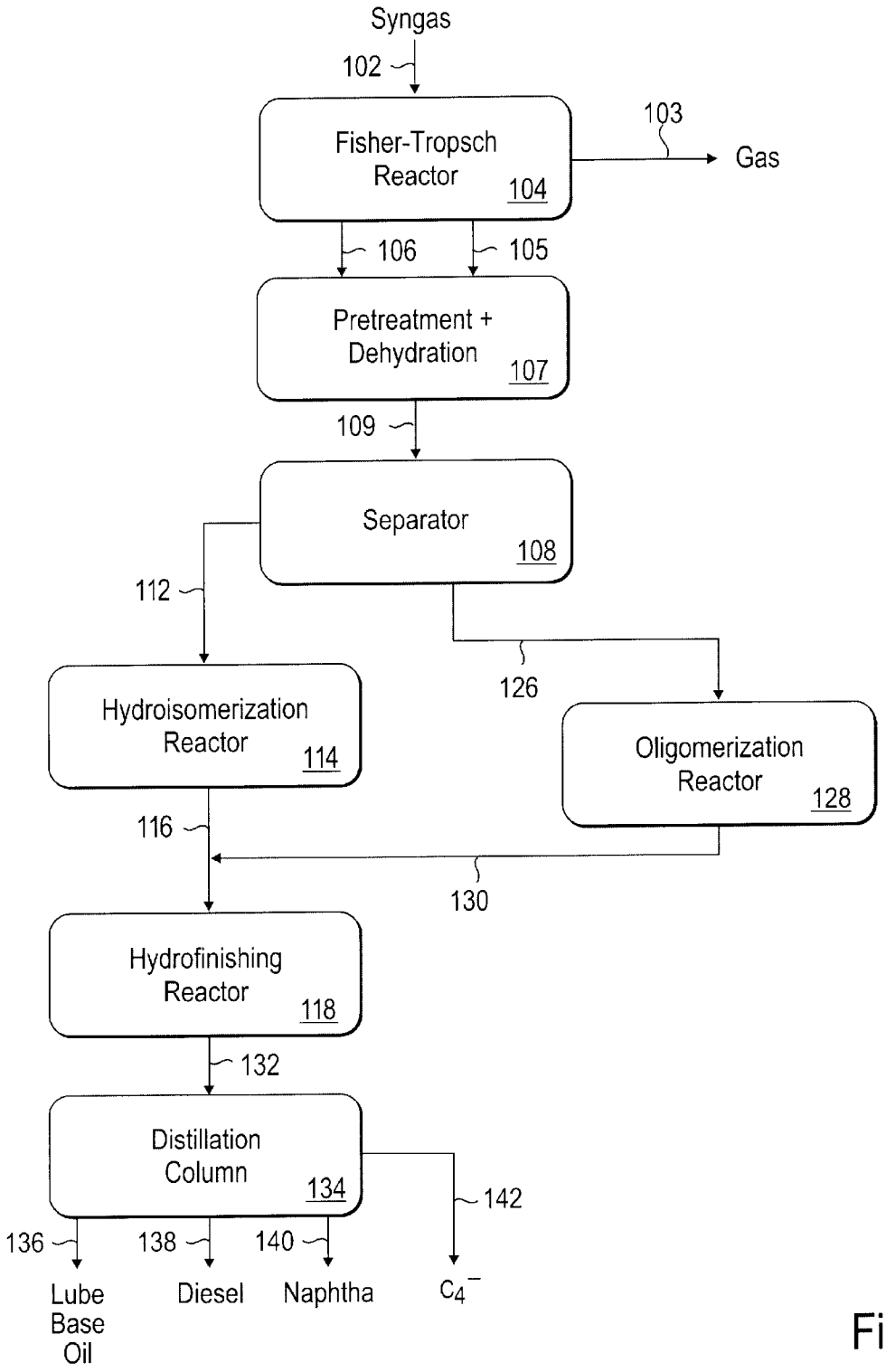
FIG. 2 is a schematic diagram of a second embodiment of the present invention in which the Fischer-Tropsch syncrude is sent to a pretreatment operation in which various contaminants are removed and the oxygenated hydrocarbons converted to olefins prior to separation of the syncrude into the Fischer-Tropsch condensate and the Fischer-Tropsch wax.

FIG. 2 illustrates an alternative embodiment of the invention in which the condensate fraction and the Fischer-Tropsch wax from the Fischer-Tropsch reactor are passed to a dehydration zone where the alcohols are converted to olefins and the contaminants, such as nitrogen and certain oxygenates, are removed prior to a separation step. In this embodiment the syngas is passed by feed inlet 102 to the Fischer-Tropsch reactor 104. The gas phase is shown as leaving the reactor via outlet 103. Outlet 105 from the Fischer-Tropsch reactor carries the condensate fraction, and the Fischer-Tropsch wax fraction is carried away by outlet 106. Both the condensate and wax fraction are shown as passing together to a dehydration zone 107 where alcohols are dehydrated to yield olefins. In addition, contaminants also can be removed at this step. The pretreated syncrude feedstock is sent to the separator 108 via conduit 109. In the separator the Fischer-Tropsch wax fraction and the Fischer-Tropsch condensate fraction are again separated. The Fischer-Tropsch wax fraction is recovered from the separator in line 112 and sent to the hydroisomerization reactor 114. The Fischer-Tropsch condensate fraction is collected in line 126 and sent to the oligomerization reactor 128. The remainder of FIG. 2 is similar to the scheme shown in FIG. 1. The high boiling intermediate comprising isomerized wax from the hydroisomerization unit is collected by outlet 116 and carried to the hydrofinishing unit 118. The intermediate oligomerization mixture recovered from the oligomerization unit 128 is collected by conduit 130 and mixed with the high boiling intermediate, and both intermediates pass together into the hydrofinishing reactor 118. The hydrofinished products are carried by conduit 132 to the distillation column 134 where the lubricating base oil 136, diesel 138, naphtha 140, and any $C_4$ minus product 142 are separately recovered.

Fischer-tropsch Synthesis

In the Fischer-Tropsch synthesis process, liquid and gaseous hydrocarbons are formed by contacting a synthesis gas (syngas) comprising a mixture of hydrogen and carbon monoxide with a Fischer-Tropsch catalyst under suitable temperature and pressure reactive conditions. The Fischer-Tropsch reaction is typically conducted at temperatures of from about 300 degrees to about 700 degrees F. (149 degrees to 371 degrees C.) preferably from about 400 degrees to about 550 degrees F. (204 degrees to 228 degrees C.); pressures of from about 10 to about 600 psia, (0.7 to 41 bars) preferably 30 to 300 psia, (2 to 21 bars) and catalyst space velocities of from about 100 to about 10,000 cc/g/hr., preferably 300 to 3,000 cc/g/hr.

The products may range from $C_1$ to $C_{200}$ plus hydrocarbons with a majority in the $C_5$–$C_{100}$ plus range. The reaction can be conducted in a variety of reactor types, for example, fixed bed reactors containing one or more catalyst beds, slurry reactors, fluidized bed reactors, or a combination of different type reactors. Such reaction processes and reactors are well known and documented in the literature. Slurry Fischer-Tropsch processes, which is a preferred process in the practice of the invention, utilize superior heat (and mass) transfer characteristics for the strongly exothermic synthesis reaction and are able to produce relatively high molecular weight, paraffinic hydrocarbons when using a cobalt catalyst. In a slurry process, a syngas comprising a mixture of hydrogen and carbon monoxide is bubbled up as a third phase through a slurry in a reactor which comprises a particulate Fischer-Tropsch type hydrocarbon synthesis catalyst dispersed and suspended in a slurry liquid comprising hydrocarbon products of the synthesis reaction which are liquid at the reaction conditions. The mole ratio of the hydrogen to the carbon monoxide may broadly range from about 0.5 to about 4, but is more typically within the range of from about 0.7 to about 2.75 and preferably from about 0.7 to about 2.5.A particularly preferred Fischer-Tropsch process is taught in EP0609079, also completely incorporated herein by reference for all purposes.

Suitable Fischer-Tropsch catalysts comprise one or more Group Vlll catalytic metals such as Fe, Ni, Co, Ru and Re, with cobalt being preferred. Additionally, a suitable catalyst may contain a promoter. Thus, a preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Suitable support materials include alumina, silica, magnesia and titania or mixtures thereof. Preferred supports for cobalt containing catalysts comprise titania. Useful catalysts and their preparation are known and illustrated in U.S. Pat. Nos. 4,568,663, which is intended to be illustrative but non-limiting relative to catalyst selection.

Catalytic Dewaxing

Catalytic dewaxing consists of three main classes, conventional hydrodewaxing, complete hydroisomerization dewaxing, and partial hydroisomerization dewaxing. All three classes involve passing a mixture of a waxy hydrocarbon stream and hydrogen over a catalyst that contains an acidic component to convert the normal and slightly branched iso-paraffins in the feed to other non-waxy species, such as lubricating base oil stocks with acceptable pour points. Typical conditions for all classes involve temperatures from about 400 degrees F. to about 800 degrees F. (200 degrees C. to 425 degrees C.), pressures from about 200 psig to 3000 psig, and space velocities from about 0.2 to 5 hr−1. The method selected for dewaxing a feed typically depends on the product quality, and the wax content of the feed, with conventional hydrodewaxing often preferred for low wax content feeds. The method for dewaxing can be effected by the choice of the catalyst. The general subject is reviewed by Avilino Sequeira, in *Lubricant Base Stock and Wax Processing*, Marcel Dekker, Inc. pages 194–223. The determination between conventional hydrodewaxing, complete hydroisomerization dewaxing, and partial hydroisomerization dewaxing can be made by using the n-hexadecane isomerization test as described in U.S. Patent No. 5,282,958. When measured at 96 percent, n-hexadecane conversion using conventional hydrodewaxing catalysts will exhibit a selectivity to isomerized hexadecanes of less than 10 percent, partial hydroisomerization dewaxing catalysts will exhibit a selectivity to isomerized hexadecanes of greater than 10 percent to less than 40 percent, and complete hydroisomerization dewaxing catalysts will exhibit a selectivity to isomerized hexadecanes of greater than or equal to 40 percent, preferably greater than 60 percent, and most preferably greater than 80 percent.

In conventional hydrodewaxing, the pour point is lowered by selectively cracking the wax molecules mostly to smaller paraffins using a conventional hydrodewaxing catalyst, such as, for example ZSM-5. Metals may be added to the catalyst, primarily to reduce fouling. In the present invention conventional hydrodewaxing may be used to increase the yield of lower molecular weight products in the final product slate by cracking the Fischer-Tropsch wax molecules.

Complete hydroisomerization dewaxing typically achieves high conversion levels of wax by isomerization to non-waxy iso-paraffins while at the same time minimizing the conversion by cracking. Since wax conversion can be complete, or at least very high, this process typically does not need to be combined with additional dewaxing processes to produce a lubricating base oil stock with an acceptable pour point. Complete hydroisomerization dewaxing uses a dual-functional catalyst consisting of an acidic component and an active metal component having hydrogenation activity. Both components are required to conduct the isomerization reaction. The acidic component of the catalysts used in complete hydroisomerization preferably include an intermediate pore SAPO, such as SAPO-11, SAPO-31, and SAPO-41, with SAPO-11 being particularly preferred. Intermediate pore zeolites, such as ZSM-22, ZSM-23, and SSZ-32, also may be used in carrying out complete hydroisomerization dewaxing. Typical active metals include molybdenum, nickel, vanadium, cobalt, tungsten, zinc, platinum, and palladium. The metals platinum and palladium are especially preferred as the active metals, with platinum most commonly used.

In partial hydroisomerization dewaxing a portion of the wax is isomerized to iso-paraffins using catalysts that can isomerize paraffins selectively, but only if the conversion of wax is kept to relatively low values (typically below 50 percent). At higher conversions, wax conversion by cracking becomes significant, and yield losses of lubricating base oil stock becomes uneconomical. Like complete hydroisomerization dewaxing, the catalysts used in partial hydroisomerization dewaxing include both an acidic component and a hydrogenation component. The acidic catalyst components useful for partial hydroisomerization dewaxing include amorphous silica aluminas, fluorided alumina, and 12-ring zeolites (such as Beta, Y zeolite, L zeolite). The hydrogenation component of the catalyst is the same as already discussed with complete hydroisomerization dewaxing. Because the wax conversion is incomplete, partial hydroisomerization dewaxing must be supplemented with an additional dewaxing technique, typically solvent dewaxing, complete hydroisomerization dewaxing, or conventional hydrodewaxing in order to produce a lubricating base oil stock with an acceptable pour point (below about +10 degrees F. or−12 degrees C.).

In preparing those catalysts containing a SAPO non-zeolitic molecular sieve and having an hydrogenation component for use in the present invention, it is usually preferred that the metal be deposited on the catalyst using a nonaqueous method. Catalysts containing SAPO's on which the metal has been deposited using a non-aqueous method have shown greater selectivity and activity than those catalysts which have used an aqueous method to deposit the active metal. The non-aqueous deposition of active metals on non-zeolitic molecular sieves is taught in U.S. Pat. No. 5,939,349. In general, the process involves dissolving a compound of the active metal in a non-aqueous, nonreactive solvent and depositing it on the molecular sieve by ion exchange or impregnation.

For the purposes of the present invention, hydroisomerization dewaxing, especially complete hydroisomerization dewaxing, is preferred over hydrodewaxing if such operation is able to provide the desired viscosity and pour point specifications for the product. This is because with less wax cracking, the yield of lubricating base oil will be increased. The preferred hydroisomerization catalyst for use in the catalytic hydroisomerization step comprises SAPO-11.

In the process of the present invention the dewaxing step may be carried out continuously, that is the entire Fischer-Tropsch wax fraction from the separator is sent continuously to the catalytic dewaxing reactor. Alternatively, the Fischer-Tropsch wax fraction may be further divided into two or more fractions having different boiling points and the various wax fractions dewaxed in block operation. Block operation has the advantage of allowing the dewaxer to be operated at optimal conditions for the particular product being dewaxed.

The dewaxing step may optionally include a hydrotreating stage to remove nitrogen and oxygen impurities from the feedstock before it goes to the dewaaxing catalyst. The hydrotreating could be a separate reactor ahead of the dewaxer. Many hydrotreating catalysts are suitable. The nitrogen should be reduced to low levels (preferably less than 5 ppm) without excess cracking of the feedstock.

Dehydration pretreatment

The alcohols in the feed are dehydrated to convert them into olefins prior to the oligomerization step. In general, the dehydration of alcohols may be accomplished by processing the feedstock over a catalyst, typically gamma alumina. Dehydration of alcohols to olefins is discussed in Chapter 5, "Dehydration" in *Catalytic Processes and Proven Catalysts* by Charlwes L. Thomas, Academic Press, 1970.

Oxygenates, including alcohols not converted in the dehydration step, nitrogen compounds, and water can deactivate the catalyst in the oligomerization reactor and in the dewaxer. Therefore, it is preferred to remove such contaminants from the feedstock prior to oligomerization and dewaxing using a pretreatment step. Means for removing these contaminants are in the literature and are well known to those skilled in the art. For example, the contaminants may be removed by extraction, water washing, adsorption, or by a combination of these processes. Dehydration and contaminant removal may be combined into a single operation. Preferably, the nitrogen in the feedstock to the oligomerization reactor should be below 50 ppm, more preferably blow 10 ppm, and most preferably loss than 1 ppm.

Oligomerization

The present invention is intended to maximize the yield of heavy products, especially lubricating base oils and diesel, by oligomerizing the olefins in the Fischer-Tropsch condensate and those olefins produced in the dehydration operation. During oligomerization the lighter olefins are converted into heavier products. The carbon backbone of the oligomers will also display branching at the points of molecular addition. Due to the introduction of branching into the molecule, the pour point properties of the products are enhanced making the final products of the oligomerization operation excellent candidates for blending components to upgrade lower quality conventional petroleum-derived products to meet market specifications.

The oligomerization of olefins has been well reported in the literature and a number of commercial processes are available. See, for example, U.S. Pat. Nos. 4,417,088; 4,827, 064; 4,827,073; and 4,990,709. Various types of reactor configurations may be employed, with the fixed catalyst bed reactor being used commercially. More recently, performing the oligomerization in an ionic liquids media has been proposed since the contact between the catalyst and the reactants is efficient and the separation of the catalyst from the oligomerization products is facilitated. Preferably, the oligomerized product will have an average molecular weight at least 10 percent higher than the initial feedstock, preferably at least 20 percent higher. The oligomerization reaction will proceed over a wide range of conditions. Typical temperatures for carrying out the reaction are between about 32 degrees F. (0 degrees C.) and about 800 degrees F. (425 degrees C.). Other conditions include a space velocity from 0.1 to 3 LHSV and a pressure from 0 to 2000 psig. Catalysts for the oligomerization reaction can be virtually any acidic material, such as, for example, zeolites, clays, resins, $BF_3$ complexes, HF, $H_2SO_4$, $AlCl_3$, ionic liquids (preferably ionic liquids containing a Bronsted or Lewis acidic component or a combination of Bronsted and Lewis acid components), transition metal-based catalysts (such as $Cr/SiO_2$), superacids, and the like. In addition, non-acidic oligomerization catalysts including certain organometallic or transition metal oligomerization catalysts may be used, such as, for example, zirconacenes.

Hydrofinishing

Hydrofinishing operations are intended to improve the UV stability and color of the products. It is believed this is accomplished by saturating the double bonds present in the hydrocarbon molecule. In the process of the present invention, both the high boiling intermediate recovered from the dewaxing operation and the intermediate oligomerization mixture recovered from the oligomerization operation are sent to a hydrofinisher. A general description of the hydrofinishing process may be found in U.S. Pat. Nos. 3,852,207 and 4,673,487. As used in this disclosure the term UV stability refers to the stability of the lubricating base oil or other products when exposed to ultraviolet light and oxygen. Instability is indicated when a visible precipitate forms or darker color develops upon exposure to ultraviolet light and air which results in a cloudiness or floc in the product. Lubricating base oils and diesel products prepared by the process of the present invention will require UV stabilization before they are suitable for use in the manufacture of commercial lubricating oils and marketable diesel.

In the present invention the total pressure in the hydrofinishing zone will be above 500 psig, preferably above 1000 psig, and most preferably will be above 1500 psig. The maximum total pressure is not critical to the process, but due to equipment limitations the total pressure will not exceed 3000 psig and usually will not exceed about 2500 psig. Temperature ranges in the hydrofinishing zone are usually in the range of from about 300 degrees F. (150 degrees C.) to about 700 degrees F. (370 degrees C.), with temperatures of from about 400 degrees F. (205 degrees C.) to about 500 degrees F. (260 degrees C.) being preferred. The LHSV is usually within the range of from about 0.2 to about 2.0, preferably 0.2 to 1.5 and most preferably from about 0.7 to 1.0. Hydrogen is usually supplied to the hydrofinishing zone at a rate of from about 1000 to about 10,000 SCF per barrel of feed. Typically the hydrogen is fed at a rate of about 3000 SCF per barrel of feed.

Suitable hydrofinishing catalysts typically contain a Group VIII noble metal component together with an oxide support. Metals or compounds of the following metals are contemplated as useful in hydrofinishing catalysts include ruthenium, rhodium, iridium, palladium, platinum, and osmium. Preferably the metal or metals will be platinum, palladium or mixtures of platinum and palladium. The refractory oxide support usually consists of silica-alumina, silica-alumina-zirconia, and the like. Typical hydrofinishing catalysts are disclosed in U.S. Pat. No. 3,852,207; 4,157,294; and 4,673,487.

The process of the present invention is particularly advantageous because it produces a large volume of lubricating base oils which is the highest value product. The lubricating base oil is especially high in quality due to its high paraffinic composition and excellent oxidation stability. Lubricating base oil produced by the present process may be used to make high value premium lubricating products. Therefore the present process allows the production of a wide range of lubricating base oil products, including bright stock. The diesel produced by the process also is particularly high in quality due to its low sulfur content, low level of aromatics, high cetane number, and very low pour point and cloud point.

The process of the present invention is very flexible. The cut-point between the Fischer-Tropsch condensate fraction and the Fischer-Tropsch wax fraction may be adjusted to either increase the yield of diesel by sending more diesel boiling-range material through the dewaxing step. Alternatively, the cut-point may be adjusted to increase the amount of lubricating base oil by sending more diesel boiling-range material through the oligomerization step. The oligomerization step is able to convert naphtha and diesel boiling-range olefins to lubricating base oils. The process may also be operated to upgrade only the lower value naphtha to diesel and lubricating base oil.

The following examples are included to further illustrate the invention but are not intended to be a limitation on it.

EXAMPLES

Example 1

A typical Fischer-Tropsch condensate was prepared having the following preperties:

API Gravity=59.3

Bromine number=50.7 g Br/100 g sample

Calculated olefin content=50.9 wt %.

Oxygen=1.6 wt % (by neutron activation method)

Nitrogen=0.5 ppm 99.5 wt % point by ASTM D2887 distillation=639 degrees F.

Example 2

The dehydration of alcohols in the Fischer-Tropsch condensate of Example 1 was demonstrated by reacting the condensate over a gamma alumina catalyst in a continuous-flow packed bed reactor at 3.0 LHSV, 50 psig, and 730 degrees F. catalyst temperature. The product went to a settler where the hydrocarbon and water phases were drawn off separately. Analyses of the hydrocarbon product yielded the following results:

API Gravity=58.4

Bromine number=64.1 gBr/100 g sample

Calculated olefin content=62.1 wt %.

Oxygen=0.2 wt %.

99.5 wt % point by ASTM D2887 distillation=627 degrees F.

Note the increase in the olefin content from 50.9 wt. % to 62.1 wt. % and the corresponding decrease in the oxygen.

Example 3

The dehydrated condensate from Example 2 was oligomerized by reacting it over a $Cr/SiO_2$ catalyst in a continuous-flow packed bed reactor at 0.5 LHSV, 1600 psig, and 750 degrees F. catalyst temperature. The product from the reactor was distilled at a 650 degree F. cutpoint. The 650 degree F. minus material was paraffins and unreacted olefins. The 650 degree F. plus oligomerized product was lube base oil. The 650 degree F. plus product yield was 34.4 wt % and the 1000 degree F. plus product (bright stock) yield was 2.6 wt %. Properties of the 650F+ product were as follows:

Vis@40 degrees C.=13.97 cSt

Vis@100 degrees C.=3.464 cSt

VI=128

Pour point=−6 degrees C.

Example 4

A typical Fischer-Tropsch wax was prepared having the following properties:

API Gravity=40.2

Nitrogen=8 ppm

Oxygen=0.69 wt %

Pour point=76 degrees C.

Example 5

The Fischer-Tropsch wax of Example 4 was processed in a two reactor continuous-flow pack bed pilot plant. The first reactor contained a dewaxing catalyst comprising an alumina-bound SAPO-11 with Pt. The second reactor contained a hydrofinishing catalyst: Pt/Pd on a silica/alumina support. The system operated at 1000 psig total pressure with 10000 SCF/B recycle hydrogen flow. Properties of the 650 degrees F. plus product were:

Vis@40 degrees C.=16.59 cSt

Vis@100 degrees C.=4.103 cSt

VI=156

Pour point=−21 degrees C.

Note the drop in pour point from 76 degrees C. to−21 degrees C.

What is claimed is:

1. A process for increasing the yield of $C_{10}$ plus hydrocarbon products from a Fischer-Tropsch plant which comprises:

(a) separating a feedstock comprising $C_5$ plus Fischer-Tropsch products recovered from the Fischer-Tropsch plant into a Fischer-Tropsch wax-fraction and a Fischer-Tropsch condensate fraction, wherein the Fischer-Tropsch condensate fraction contains alcohols boiling below about 400 degrees C.;

(b) dewaxing the Fischer-Tropsch wax fraction in a catalytic dewaxing zone to produce a high boiling intermediate having a lower pour point as compared to the Fischer-Tropsch wax fraction;

(c) hydrofinishing the high boiling intermediate in a hydrofinishing zone;

(d) contacting the Fischer-Tropsch condensate fraction separated in step (a) with a dehydration catalyst in a dehydration zone, whereby at least some of the alcohols present in the fraction are converted to olefins;

(e) oligomerizing the olefins in the Fischer-Tropsch condensate fraction to form a intermediate oligomerization mixture having a higher average molecular weight than the Fischer-Tropsch condensate fraction;

(f) hydrofinishing the intermediate oligomerization mixture in the hydrofinishing zone; and (g) recovering from the hydrofinishing zone a $C_{10}$ plus hydrocarbon product.

2. The process of claim 1 wherein the Fischer-Tropsch Wax fraction contains at least 40 weight percent of $C_{20}$ or higher hydrocarbons.

3. The process of claim 2 wherein the Fischer-Tropsch Wax fraction contains at least 70 weight percent of $C_{20}$ or higher hydrocarbons.

4. The process of claim 1 wherein a $C_9$ minus hydrocarbon product is also recovered from the hydrofinishing zone.

5. The process of claim 4 wherein at least part of the $C_9$ minus hydrocarbon product comprises naphtha.

6. The process of claim 4 wherein at least part of the $C_9$ minus hydrocarbon product comprises LPG.

7. The process of claim 1 wherein the $C_{10}$ plus hydrocarbon product comprises a lubricating base oil product and a diesel product.

8. The process of claim 7 wherein the $C_{10}$ plus-hydrocarbon product further comprises bright stock.

9. The process of claim 8 wherein the bright stock at 40 degrees C. has a viscosity of at least 250 cSt.

10. The process of claim 9 wherein the bright stock at 40 degrees C. has a viscosity of at least 400 cSt.

11. The process of claim 1 wherein the dewaxing of step (b) is a catalytic hydroisomerization dewaxing process.

12. The process of claim 11 wherein the catalyst employed in the catalytic hydroisomerization dewaxing process comprises SAPO-11 type catalyst.

13. The process of claim 1 wherein the intermediate oligomerization mixture of step (e) has an average molecular weight at least 20 percent higher than the Fischer-Tropsch condensate fraction.

14. The process of claim 1 wherein the oligomerization of the olefins in the Fischer-Tropsch condensate is carried out in an ionic liquid medium.

15. The process of claim 1 wherein the oligomerization of the olefins in the Fischer-Tropsch condensate is carried out in a fixed-bed catalyst reactor.

16. The process of claim 1 including the additional step of pre-treating Fischer-Tropsch condensate fraction prior to oligomerization to remove oligomerization catalyst poisons.

17. The process of claim 1 wherein the Fischer-Tropsch wax fraction is dewaxed in the dewaxing zone in a continuous bulk dewaxing process.

18. The process of claim 1 including the additional steps of distilling the Fischer Tropsch wax fraction prior to dewaxing step (b); separately collecting at least a heavy Fischer Tropsch wax fraction and a light Fischer Tropsch wax fraction; and separately dewaxing said heavy and light Fischer Tropsch wax fractions in a block flow dewaxing process.

19. The process of claim 1 wherein the Fischer-Tropsch plant employs a slurry-type Fischer-Tropsch reactor.

20. A process for increasing the yield of $C_{10}$ plus hydrocarbon products from a Fischer-Tropsch plant which comprises:

(a) contacting a $C_2$ plus feedstock containing alcohols recovered from the Fischer-Tropsch plant with a dehydration catalyst under dehydration conditions to convert at least some of the alcohols present into olefins;

(b) separately recovering from the pretreated $C_2$ plus feedstock a Fischer-Tropsch wax fraction and a Fischer-Tropsch condensate fraction comprising both saturated hydrocarbons and olefins having an upper boiling point below about 400 degrees C.;

(c) dewaxing the Fischer-Tropsch wax fraction in a catalytic dewaxing zone to produce a high boiling intermediate having a lower pour point as compared to the Fischer-Tropsch wax fraction;

(d) hydrofinishing the high boiling intermediate in a hydrofinishing zone;

(e) oligomerizing the olefins in the Fischer-Tropsch condensate fraction recovered in step (b) to form a intermediate oligomerization mixture having a higher average molecular weight than the Fischer-Tropsch condensate fraction;

(f) hydrofinishing the intermediate oligomerization mixture in the hydrofinishing zone; and (g) recovering from the hydrofinishing zone a $C_{10}$ plus hydrocarbon product.

21. The process of claim 20 wherein the Fischer-Tropsch Wax fraction contains at least 40 weight percent of $C_{20}$ or higher hydrocarbons.

22. The process of claim 21 wherein the Fischer-Tropsch Wax fraction contains at least 70 weight percent of $C_{20}$ or higher hydrocarbons.

23. The process of claim 20 wherein the $C_{10}$ plus hydrocarbon product comprises a lubricating base oil product and a diesel product.

24. The process of claim 23 wherein the $C_{10}$ plus hydrocarbon product further comprises bright stock.

25. The process of claim 24 wherein the bright stock at 40 degrees C. has a viscosity of at least 250 cSt.

26. The process of claim 25 wherein the bright stock at 40 degrees C. has a viscosity of at least 400 cSt.

27. The process of claim 20 wherein the dewaxing of step (c) is a catalytic hydroisomerization dewaxing process.

28. The process of claim 27 wherein the catalyst employed in the catalytic hydroisomerization dewaxing process comprises SAPO-11 type catalyst.

29. The process of claim 20 wherein the intermediate oligomerization mixture of step (e) has an average molecular weight at least 20 percent higher than the Fischer-Tropsch condensate fraction.

30. The process of claim 20 wherein the oligomerization of the olefins in the Fischer-Tropsch condensate is carried out in an ionic liquid medium.

31. The process of claim 20 wherein the oligomerization of the olefins in the Fischer-Tropsch condensate is carried out in a fixed-bed catalyst reactor.

32. The process of claim 20 wherein the Fischer-Tropsch wax fraction is dewaxed in the dewaxing zone in a continuous bulk dewaxing process.

33. The process of claim 20 including the additional steps of distilling the Fischer-Tropsch wax fraction prior to dewaxing step (c); separately collecting at least a heavy Fischer Tropsch wax fraction and a light Fischer Tropsch wax fraction; and separately dewaxing said heavy and light Fischer Tropsch wax fractions in a block flow dewaxing process.

34. The process of claim 20 wherein the Fischer-Tropsch plant employs a slurry-type Fischer-Tropsch reactor.

35. The process of claim 20 wherein the feedstock is also pretreated to remove contaminants present.

* * * * *